US005703319A

United States Patent [19]

Fritz et al.

[11] Patent Number: 5,703,319

[45] Date of Patent: Dec. 30, 1997

[54] CONNECTOR BLOCK FOR BLAST INITIATION SYSTEMS

[75] Inventors: James E. Fritz, Ellington; Thomas C. Tseka, West Suffield; Daniel P. Sutula, Jr., Farmington, all of Conn.

[73] Assignee: The Ensign-Bickford Company, Simsbury, Conn.

[21] Appl. No.: 549,160

[22] Filed: Oct. 27, 1995

[51] Int. Cl.[6] ..... C06C 5/06; C06C 7/00

[52] U.S. Cl. ..... 102/275.7; 102/275.12

[58] Field of Search ..... 102/275.3, 275.4, 102/275.7, 275.11, 275.12

[56] References Cited

U.S. PATENT DOCUMENTS

| | | | |
|---|---|---|---|
| 2,587,694 | 3/1952 | Chalmers et al. | 102/275.4 |
| 3,205,818 | 9/1965 | Coulson | 102/275.7 |
| 3,987,732 | 10/1976 | Spraggs et al. | 102/275.5 |
| 4,722,279 | 2/1988 | Yunan | 102/275.4 |
| 5,171,935 | 12/1992 | Michna et al. | 102/275.7 |
| 5,204,492 | 4/1993 | Jacob et al. | 102/275.12 |
| 5,299,500 | 4/1994 | Lindquist et al. | 102/275.12 |
| 5,398,611 | 3/1995 | Michna et al. | 102/275.7 |
| 5,423,263 | 6/1995 | Rontey et al. | 102/275.12 |
| 5,499,581 | 3/1996 | Sutula, Jr. | 102/275.7 |
| 5,524,547 | 6/1996 | Kelly et al. | 102/275.7 |

*Primary Examiner*—Michael J. Carone
*Assistant Examiner*—Theresa M. Wesson
*Attorney, Agent, or Firm*—Victor E. Libert; Frederick A. Spaeth

[57] ABSTRACT

A connector block (10) includes a clip member (30) which cooperates with the signal transmission end (12*a*) of body member (12) to define therebetween an arcuate line-retaining slot (32) within which one or more signal transmission lines (40) are received in explosive signal communication with the output end (16*a*) of a detonator (16). Clip member (30) is of decreasing thickness as sensed moving from the proximal end (30*b*) thereof towards at least its mid-point and is preferably of undiminished width from the proximal end (30*b*) thereof to the open end (32*b*) of the line-retaining slot (32). These features and the configuration of the entryway (34) cooperate to facilitate lateral insertion of signal transmission lines (40) into the line-retaining slot (32) and their retention therein over a broad temperature range of use, and provide excellent shrapnel shielding.

23 Claims, 7 Drawing Sheets

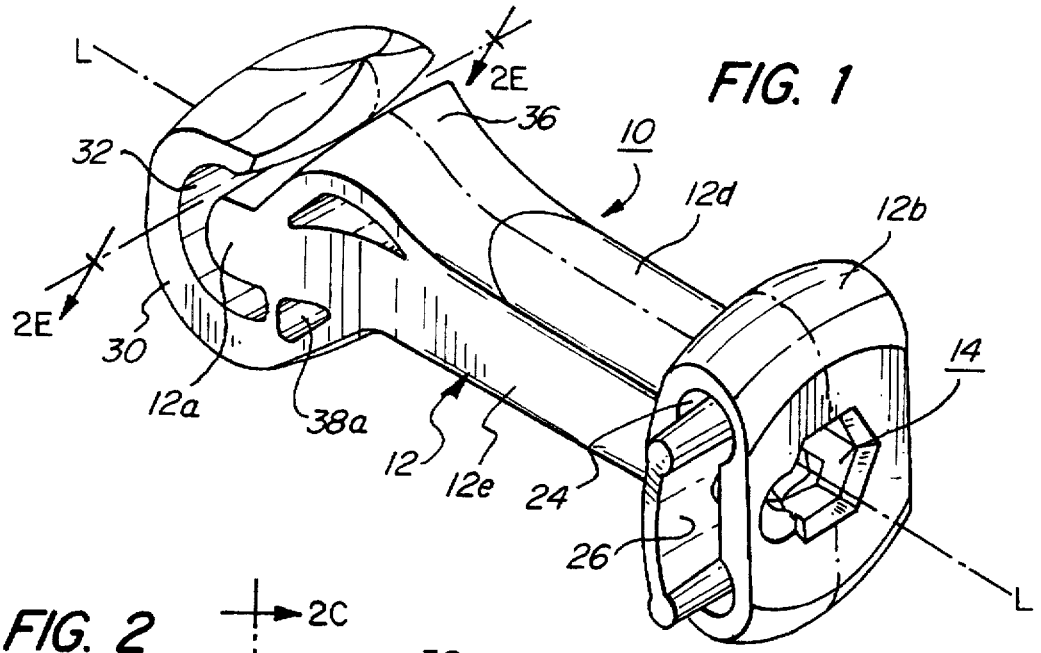
FIG. 1
FIG. 2
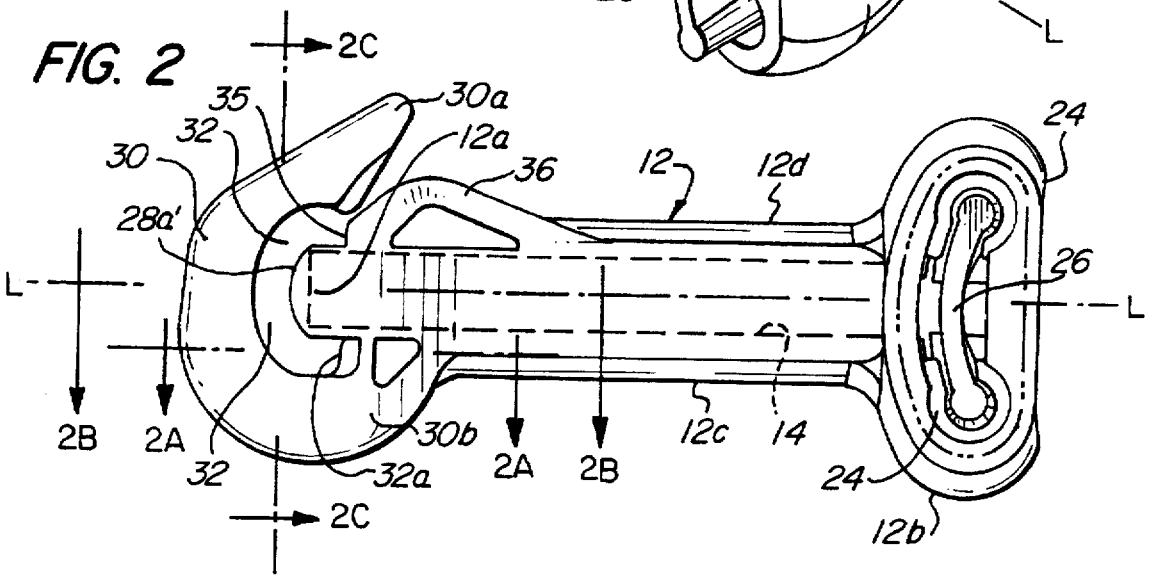
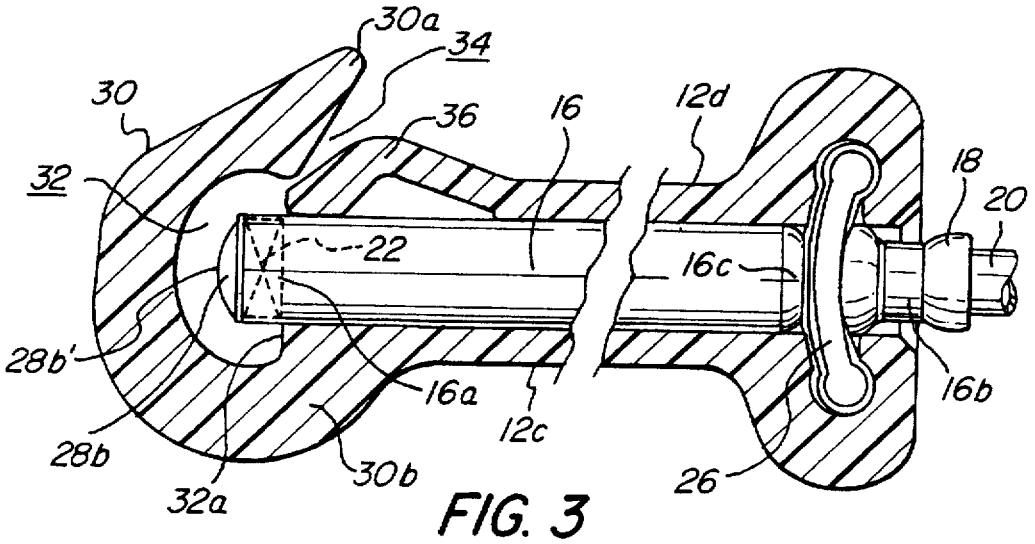
FIG. 3

FIG. 5
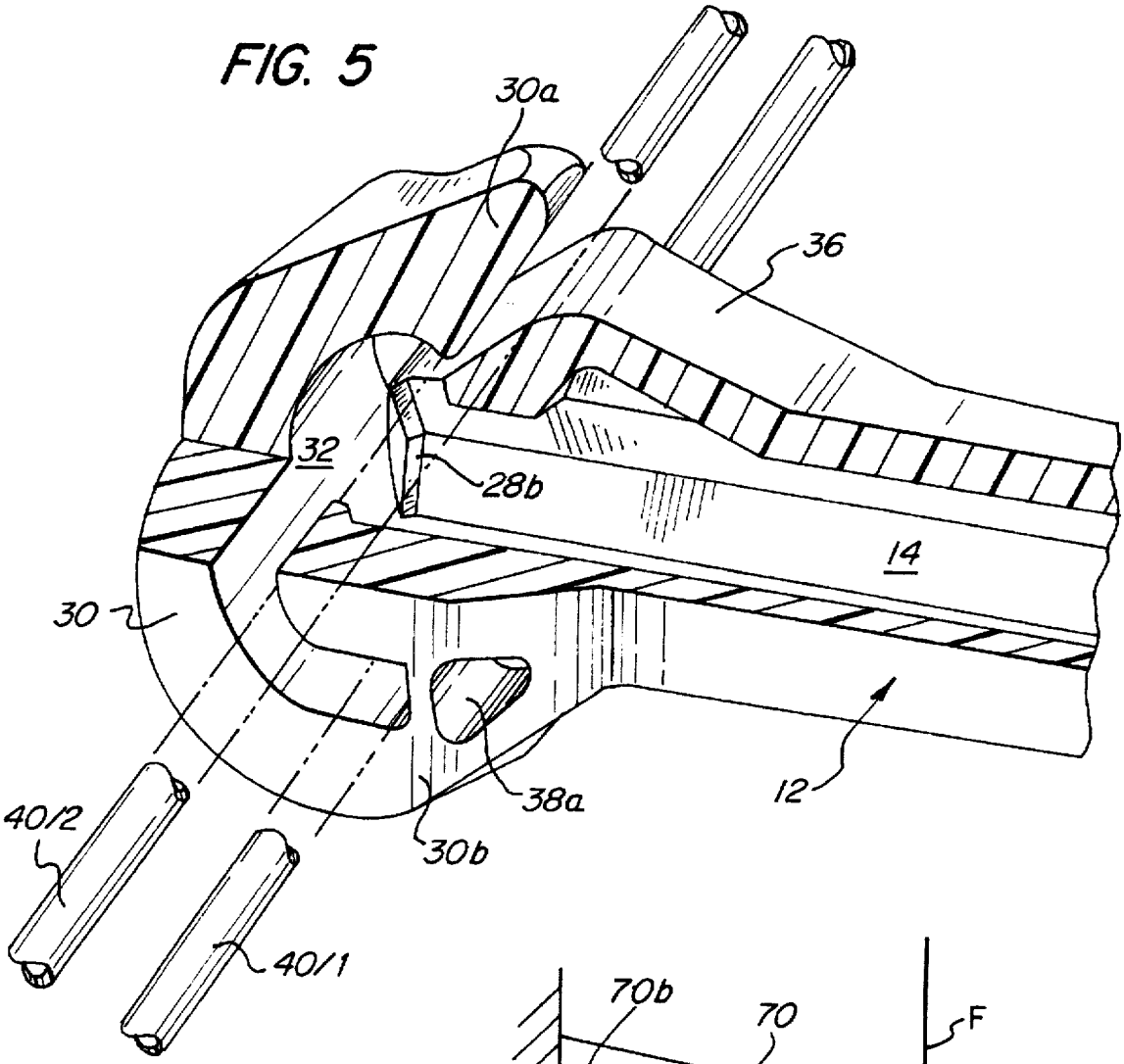
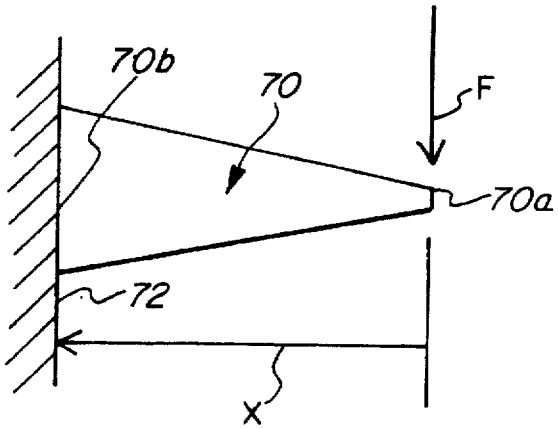
FIG. 8
(PRIOR ART)

CONNECTOR BLOCK FOR BLAST INITIATION SYSTEMS

BACKGROUND OF THE INVENTION

1. Field of the Invention

The present invention relates to connector blocks of the type utilized to connect and initiate detonation signal transmission lines, and more particularly to connector blocks including a clip member in which localized peak stresses are reduced when the clip member is flexed to permit sideways insertion of signal transmission lines into a line-retaining slot.

2. Description of Related Art

Connector blocks for blast initiation systems are well-known in the art as exemplified by U.S. Pat. Nos. 5,171,935 and 5,398,611 of R. J. Michna et al, issued, respectively, on Dec. 15, 1992 and Mar. 21, 1995. Those patents disclose a connector block having a channel formed therein for receiving a low energy detonator and an arcuate slot within which one or more signal transmission lines are retained in signal transmission juxtaposition with the detonator. Similar construction is shown in FIG. 11 of U.S. Pat. No. 5,204,492 of M. Jacob et al issued on Apr. 20, 1993.

Connector blocks of the type illustrated by the foregoing patents are usually molded as a single, unitary piece from a suitable thermoplastic synthetic organic polymeric material.

FIG. 4 of the aforementioned U.S. Pat. No. 5,398,611 illustrates a plurality of signal transmission lines, such as shock tubes, which have been inserted into the arcuate slot 37 by being forced past the converging retaining members 42, 43 formed at the entryway to slot 37. The retaining members 42, 43 are sized to offer a clearance which is slightly less than the diameter of the shock tubes so as to prevent inadvertent sideways withdrawal of the tubes 40 from the slot 37 by forces exerted on the retained tubes as they are extended to and connected at other sites in the blast pattern. Consequently, sideways insertion of the signal transmission tubes 40 into the slot 37 requires some force to insert the tubes 40 past retaining members 42, 43 because it is necessary to flex the gripping member 35 (FIG. 4 of U.S. Pat. No. 5,398,611) to force the tubes 40 through the narrow clearance offered between retaining members 42, 43. As described at column 4, line 40 et seq of U.S. Pat. No. 5,398,611, the gripping member 35 is held adjacent the end of the housing "by a resiliently deformable segment 36" which flexes, that is, is temporarily "deformed", to admit tubes 40 past members 42, 43 into slot 37.

Connector blocks of the type disclosed in the two aforementioned Michna et al patents, and with which the present invention is concerned, all require some force to insert the signal transmission lines into the line-retaining slot because if the clearance afforded at the entryway to the slot were made too large, the retained lines would be too easily inadvertently withdrawn from the line-retaining slot by the force imposed on them during set-up of the blast system.

The problem of sideways insertion is aggravated because such connector blocks are used outdoors under a wide variety of weather conditions and the thermoplastic clip or gripping member tends to become stiffer at low temperatures, requiring even higher insertion forces for sideways insertion of the lines. Such high insertion forces induce localized high bending stresses in the clip member especially at its root or proximal end where it is attached to the body of the connector block. On the other hand, if the plastic composition is modified to improve its low temperature flexibility in order to reduce the low-temperature insertion effort required, the clip or gripping member would tend to be too easily bent and perhaps permanently deformed when the connector block is used at higher temperatures. The latter situation could result in failure of the gripping or clip member to retain the signal transmission lines precisely positioned against the output end of the detonator, thereby reducing the prospects for reliable initiation of the signal transmission lines retained in the connector block.

In addition to precisely positioning the retained signal transmission lines, the gripping member must serve to protect surrounding signal transmission lines from damage due to shrapnel produced by detonation of the detonator. This objective may be attained by increasing the mass of the gripping member to provide enhanced shrapnel shielding. However, such increase in mass increases the stiffness of the gripping member and aggravates the sideways insertion problem.

The prior art as exemplified by the above-noted U.S. Pat. Nos. 5,117,935 and 5,398,611 strives to attain the objectives of relative ease of insertion of the signal transmission lines over a wide temperature range and shrapnel protection generally by thickening the gripping member opposite the output end of the detonator to serve as a shrapnel shield, and reducing the sideways insertion force required by providing a narrow neck or hinge area about which the clip member effectively pivots when the signal transmission tubes are inserted. (See column 4, lines 40–43 and 48–59, gripping member 35 and resiliently deformable segment 36 of FIGS. 1 and 4 of U.S. Pat. No. 5,398,611.) While connector blocks as illustrated in U.S. Pat. No. 5,398,611 have proved to be successful in use, they do have some drawbacks. For one, the narrow neck area (36 in FIG. 1 of U.S. Pat. No. 5,398,611) provides unshielded zones from which some shrapnel may escape. For another, the strain induced in the clip member by sideways insertion of signal transmission lines therein is concentrated in the narrow neck, increasing the danger of permanent deformation of the clip at high temperatures and the possibility of fracturing the clip at extremely low temperatures. In order to overcome these problems, such connector blocks are manufactured with a relatively low stiffness of the gripping member, to reduce transmission line insertion forces. However, this also undesireably facilitates inadvertent withdrawal of the retained transmission lines as forces are imposed upon them in the course of making other connections or other handling during set-up of the blast systems. Such prior art connector blocks must be manufactured with tightly controlled tolerances in the clearance provided by the entryway to the line-retaining slot, in order to help reduce the required insertion forces.

SUMMARY OF THE INVENTION

Generally, in accordance with the present invention, there is provided a connector block having a clip member which defines a line-retaining slot and which overcomes the prior art problems noted above. This is accomplished by providing a clip member which is essentially configured as a curved, constant-stress beam and which preferably has a constant width for at least a major portion of its length starting at the proximal end thereof.

Specifically, in accordance with the present invention, there is provided an improvement in a connector block for retaining one or more signal transmission lines, e.g., signal transmission tubes, such as shock tubes, in signal transfer relationship with a detonator. The connector block comprises the following elements. A body member has a signal transmission end and a detonator channel having a longitudinal axis and terminating in a discharge end, the channel extending within the body member for receiving and retaining therein a detonator having an output end, with the output end disposed at the discharge end of the channel when the detonator is seated therein. The projection of the periphery of the output end of such seated detonator on a plane passed through the discharge end of the channel perpendicularly to the longitudinal axis thereof serves as the origin of a hypothetical blast cone emanating from the discharge end of the channel and having a given apex angle. A line-retaining, curved clip member is disposed at the signal transmission end of the body member and cooperates therewith to define between the clip member and the body member a line-retaining slot, preferably of arcuate cross section which extends transversely of the longitudinal axis of the channel. The line-retaining slot serves to receive and retain therein at least one signal transmission line, e.g., a signal transmission tube such as a shock tube, in signal communication relationship with such output end of a detonator retained within the receiving channel. The clip member has a proximal end carried on the body member and an opposite, distal end. The line-retaining slot has a closed end adjacent the proximal end of the clip member and an open end adjacent the distal end of the clip member. An entryway is formed between the distal end of the clip member and the body member, the entryway being dimensioned and configured to admit sideways insertion of such transmission line therethrough and into the line-retaining slot by displacement of the clip member, thereby imposing a reaction load on the clip member. The improvement in the connector block comprises that the clip member is dimensioned and configured to be of decreasing thickness as sensed moving from the proximal end thereof to at least about the intersection of the clip member distal segment with a blast cone having a ninety degree apex angle.

Another aspect of the present invention provides for the clip member to be of decreasing thickness as sensed moving from the proximal end to about the mid-point of the clip member, the mid-point being defined as the intersection of an extension of the longitudinal axis with the clip member. The clip member has a clip member distal segment defined as extending from the mid-point of the clip member to the distal end thereof. Further, the clip member is of substantially uniform thickness from about the mid-point of the clip member to at least about the intersection of the clip member with a blast cone having a ninety degree apex angle.

In accordance with another aspect of the present invention, the clip member has a base width at the proximal end thereof and the width of the clip member between the proximal end thereof and about the open end of the line-retaining slot is not less than the base width.

A related aspect of the invention provides for the base width to be at least wide enough to close a blast cone having a ninety degree apex angle, preferably, to be at least wide enough to close a blast cone having a one hundred degree apex angle.

In accordance with another aspect of the present invention, the clip member has a clip member distal segment defined as extending from the mid-point of the clip member to the distal end thereof, the mid-point of the clip member being defined as the intersection of an extension of the longitudinal axis with the clip member. Further, the clip member is dimensioned and configured to have at least between the proximal end thereof and the intersection with the clip member distal segment of a blast cone having a ninety degree apex angle, the geometry of a constant stress beam having a beam longitudinal axis and which has been formed into a curved configuration by curving the beam while keeping the beam longitudinal axis in a vertical plane passed through the beam longitudinal axis.

Other aspects of the present invention provide that the connector block is comprised of a synthetic organic polymeric material, e.g., one selected from the group consisting of polyethylene, polypropylene, polybutylene and acrylonitrile-butadiene-styrene copolymer.

Yet another aspect of the present invention provides that the connector block further comprises an entry guide carried on the distal end of the clip member and an entry ramp carried on the body member. The entry guide and the entry ramp are disposed on respective opposite sides of the entryway and converge towards each other to define a converging entryway in the direction leading into the line-retaining slot. The entry guide and entry ramp afford an entryway clearance between them and define between them an entry angle of from about 18 degrees to 22 degrees, e.g., about 20 degrees. The entry guide defines with the center longitudinal axis of the detonator channel a clip reaction angle of from about 115 degrees to 120 degrees, e.g., about 120 degrees.

Still another aspect of the present invention provides that the entryway clearance afforded between the entry guide and the entry ramp changes as sensed moving laterally across the width of the entryway. For example, the entryway clearance may decrease as sensed moving laterally across the width of the entryway in opposite inward directions from the opposite lateral sides of the connector block to a point where the entryway clearance is at a minimum. In a preferred embodiment of this aspect of the invention, the entryway clearance is at a minimum at, and is symmetrical about, the lateral center of the entryway.

Another aspect of the present invention provides that the slot clearance afforded by the line-retaining slot between the clip member and the body member changes as sensed moving laterally of the connector body across the width of the slot. For example, the slot clearance may decrease as sensed moving laterally across the width of the slot in opposite inward directions from the opposite lateral sides of the connector block to a point where the slot clearance is at a minimum. In a preferred embodiment, the slot clearance is at a minimum at, and is symmetrical about, the lateral center of the slot.

Other aspects of the present invention provide that the connector block be combined with a detonator having an output end, e.g., a delay detonator, and that the detonator be disposed within the detonator channel with the output end disposed at the signal transmission end of the body member.

Still other aspects of the present invention will become apparent in the following description and the drawings appended hereto.

Reference herein and in the claims to "sideways" insertion of a signal transmission line into the line-retaining slot of a connector block refers to the method of insertion schematically illustrated in FIG. 5, wherein a length of signal transmission line is forced through entryway 34 with the longitudinal axis of the inserted length of line positioned transversely, e.g., substantially perpendicularly, to the direction of its travel through the entryway and thence into line-retaining slot 32. This is the usual mode of connection because, typically, the ends of the signal transmission lines being inserted into the connector block 12 are not available to be threaded through the line-retaining slot 32 in the manner of threading a needle. This is because the ends of the inserted lines are remote and/or immobilized and/or connected to another connector block or other device.

BRIEF DESCRIPTION OF THE DRAWINGS

FIG. 2 is a side elevation view of the connector block of FIG. 1;

FIG. 2B-1 is a somewhat enlarged version of FIG. 2B showing thereon a diagrammatic blast cone;

FIG. 2D-1 is a somewhat enlarged version of FIG. 2D showing thereon the diagrammatic blast cone of FIG. 2B-1;

FIG. 3 is a partial section view taken along a vertical plane through the center longitudinal axis of the connector block of FIG. 2;

FIG. 5 is a schematic perspective view, with parts broken away for clarity of illustration, of the portion of the connector block schematically illustrated in FIG. 4;

FIG. 8 is a schematic diagram which is used to help demonstrate the constant stress beam design parameters used in designing the clip members of the connector blocks of the present invention.

DETAILED DESCRIPTION OF THE INVENTION AND PREFERRED EMBODIMENTS THEREOF

Figure 2A:
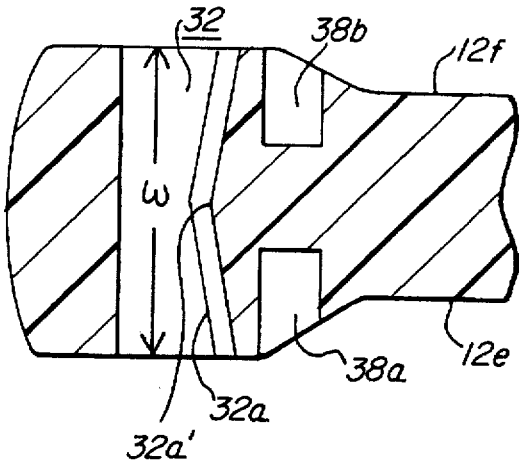
FIG. 2A is a partial section view taken along line 2A—2A of FIG. 2.
Figure 2B:
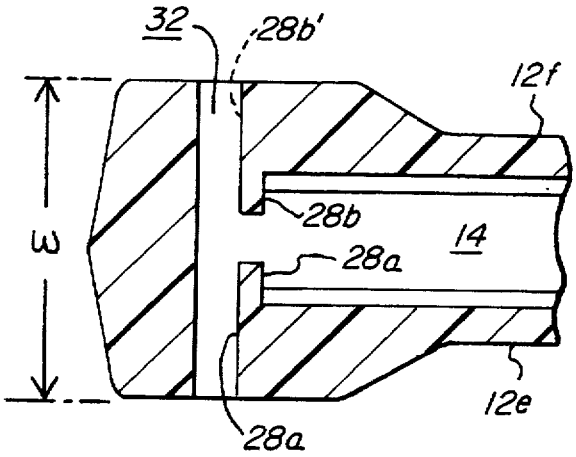
FIG. 2B is a partial section view taken along line 2B—2B of FIG. 2.
Figure 2C:
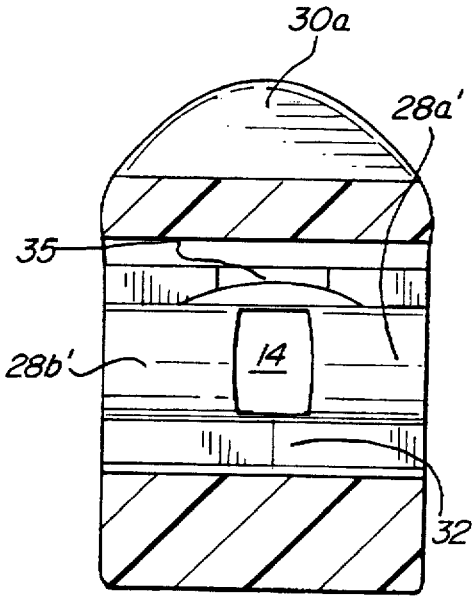
FIG. 2C is a partial section view taken along line 2C—2C of FIG. 2.
Figure 2G:
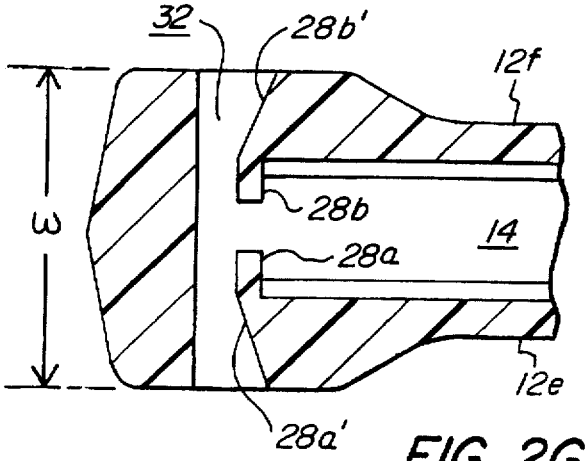
FIG. 2G is a view identical to that of FIG. 2B but of another embodiment of the present invention.
Figure 2D:
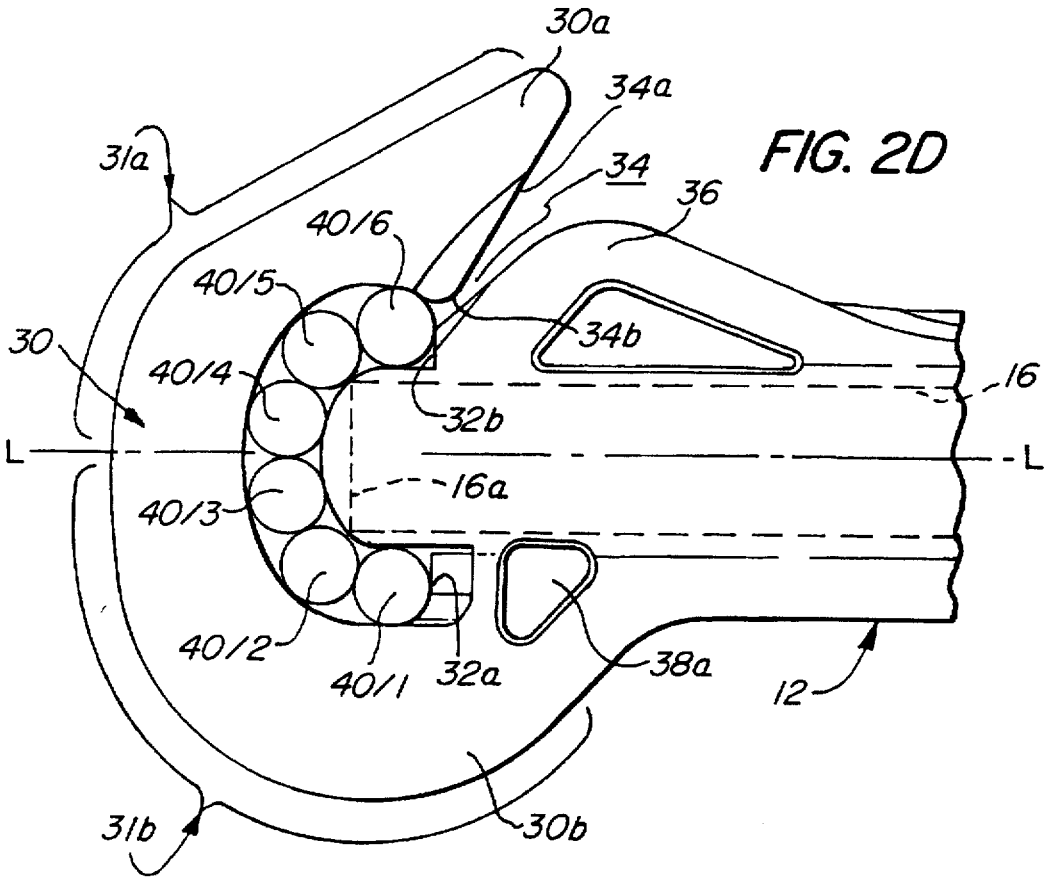
FIG. 2D is a view, enlarged with respect to FIG. 2, of the left-hand (as viewed in FIG. 2) portion of the connector block of FIG. 2 and showing a plurality of transmission lines retained therein.
Figures 1, 2B:
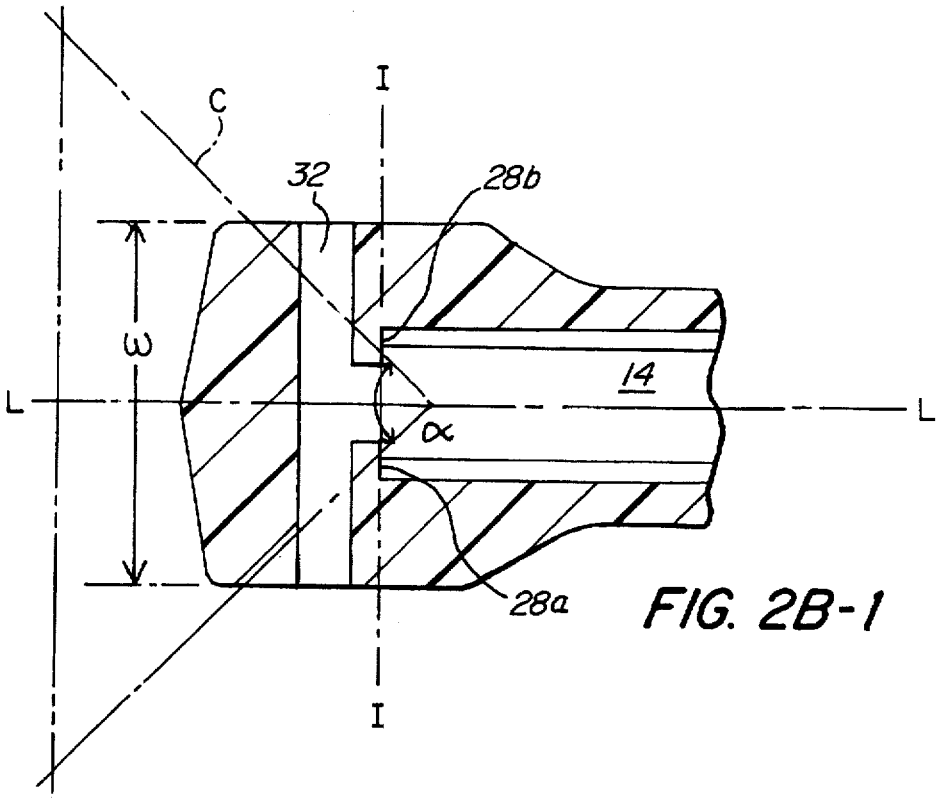
FIG. 1 is a perspective view of a connector block in accordance with one embodiment of the present invention.
Figures 1, 2D:
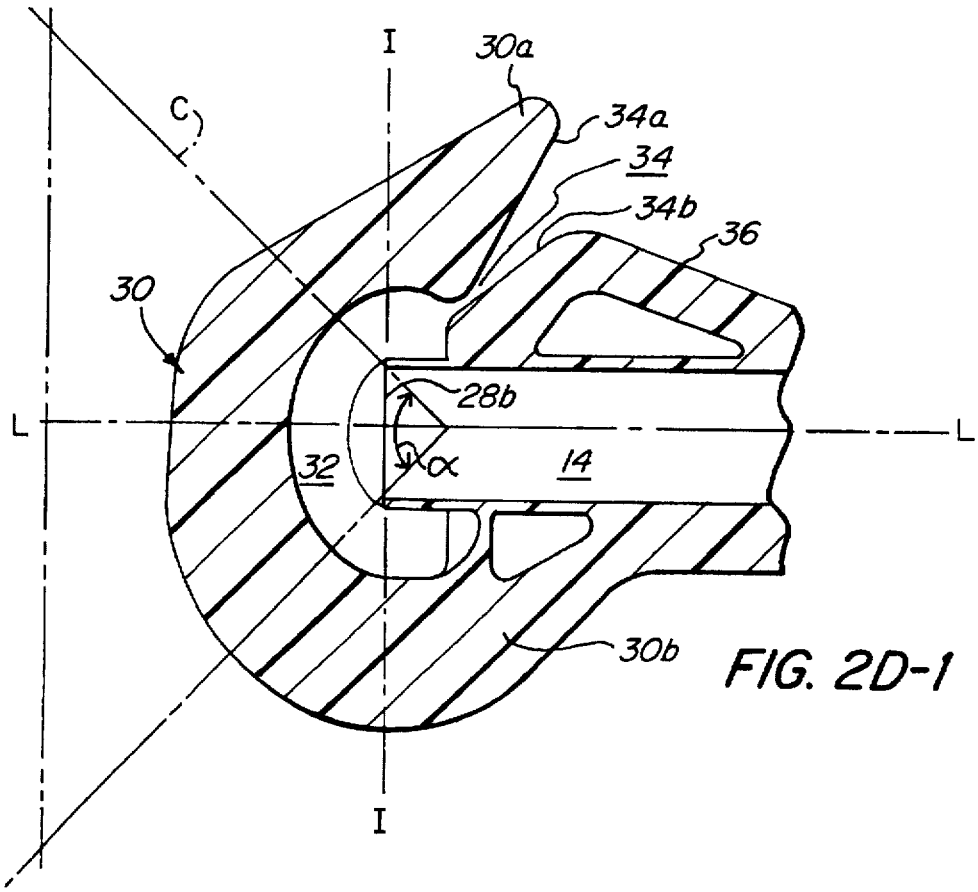

FIG. 1 shows a connector block 10 comprising a body member 12 having a signal transmission end **12*a* and a locking end 12*b*. A detonator channel 14 (FIGS. 1, 2 and 5) is of hexagonal cross section and extends through body member 12 and is dimensioned and configured to receive therein a detonator 16 as illustrated in FIG. 3. Detonator channel 14 has a longitudinal center axis L—L (FIGS. 1 and 2) which, in FIG. 2, in part overlies the section line 2B—2B. Detonator 16 is of conventional construction and has a closed, output end 16*a* and an opposite, open end 16*b* which is closed in the conventional manner, by crimping the shell (unnumbered) of the detonator about an elastomeric bushing 18, only the protruding end of which is visible in FIG. 3. As is conventional, detonator 16 has a crimp 16*c* formed adjacent open end 16*b* thereof. Crimp 16*c* secures bushing 18 and a signal transmission line 20, broken away in FIG. 3, in place within detonator 16, and seals the open end 16*b* against the environment. Detonator 16 contains an explosive charge 22 at the output end 16*a* thereof. As is well-known, detonator 16 typically includes therein a delay train of a suitable pyrotechnic material interposed between the explosive charge 22 and the signal transmission line 20 to provide a predetermined delay period between receipt of the signal at detonator 16 through signal transmission line 20 and the detonation of explosive charge 22. Signal transmission line 20 typically has a length of from about 2.4 to 61 meters (about 8 to 200 feet) and at its free end (the end which is opposite to the end crimped within detonator 16), it may be connected to an igniter or it may be crimped into a high energy detonator (not shown) suitable for use in initiating detonation of a main explosive charge. This type of arrangement is illustrated in U.S. Pat. No. 3,987,732 of R. W. Spraggs et al, issued Oct. 26, 1976. Of course, the free end of signal transmission line 20** may be otherwise suitably connected and the connector block of FIG. 3 may be used in any suitable blast system as is well-known to those skilled in the art.

Locking end **12*b* comprises a housing having a passageway 24 which extends transversely of detonator channel 14 and within which an arcuate, displaceable locking member 26 is mounted off-set to one side to leave detonator channel 14 clear. Locking member 26 may be of the type more fully described in co-pending patent application Ser. No. 08/249,522, now U.S. Pat. No. 5,499,581, filed on May 26, 1994 in the name of Daniel P. Sutula, Jr. and entitled "Molded Article Having Integral Displaceable Member or Members and Method of Use", now U.S. Pat. No. 5,499,581, or its co-pending continuation-in-part application Ser. No. 08/548,590, filed on Oct. 26, 1995 in the name of Thomas C. Tseka et al and entitled "Connector Block Having Detonator-Positioning Locking Means". Detonator 16 (FIG. 3) is mounted within connector block 10 by inserting output end 16*a* of detonator 16 into channel 14 from the locking end 12*b* (FIG. 1) thereof. Detonator 16 is then advanced through channel 14 until output end 16*a* comes to rest against the stops 28*a*, 28*b* (FIGS. 2B, 3 and 5). Detonator 16 is dimensioned and configured so that with output end 16*a* thereof positioned against stops 28*a*, 28*b*, crimp 16*c* will be aligned with locking member 26 which is then advanced through passageway 24 towards the right as viewed in FIG. 1 so that locking member 26 engages crimp 16*c* and both detonator 16 and locking member 26 are secured in place within connector block 10. Locking member 26 has an opening (not shown) formed therein at the end thereof which is enclosed within passageway 24 which opening is configured to provide a pair of legs of locking member 26 which are spread apart as they pass over crimp 16*c* and which snap together again to securely engage locking member 26 with crimp 16*c*. This configuration of locking member 26** is illustrated and explained in detail in the aforesaid co-pending patent applications Ser. Nos. 08/249,522 (now U.S. Pat. No. 5,499,581) and 08/548,590.

Connector block 10 includes a line-retaining, curved clip member 30 disposed at the signal transmission end **12*a* of body member 12. Clip member 30 cooperates with body member 12 to define therebetween a line-retaining slot 32** which is of arcuate cross section and has a width which extends laterally of the connector body 12 across the width of the slot, i.e., transversely of the longitudinal axis L—L of channel 14. The width of line-retaining slot 32 is defined by, i.e., is the same as, the base width w of clip member 30 at the proximal end 30*b* thereof (FIGS. 2A, 2B and 2G). As best seen in FIG. 2D, an entryway 34 to line-retaining slot 32 is formed between the distal end 30*a* of clip member 30 and a raised formation 36 on body member 12 at a location thereon adjacent to distal end 30*a* of clip member 30. An entry guide 34*a* is formed on distal end 30*a* and an entry ramp 34*b* is formed on raised formation 36. Entry guide 34*a* and entry ramp 34*b* are disposed opposite each other and converge towards each other in the direction moving from entryway 34 into line-retaining slot 32 to define a converging entryway leading to line-retaining slot 32. As seen in FIGS. 2D and 2E, clearance is provided between entry guide 34*a* and entry ramp 34*b* for lateral insertion of a signal transmission line 40 therethrough, the clearance being less than the diameter of the signal transmission lines to be used with the connector block, thereby requiring that the signal transmission line flex or open clip member 30 slightly to gain admittance to line-retaining slot 32. Once inserted therein, clip member 30 returns to its original position, reducing the clearance of entryway 34 and, in cooperation with flat shoulder 35 (FIGS. 2 and 2F) prevents withdrawal of the retained signal transmission line.

The proximal end 30*b* of clip member 30 is carried on the body member 12 at the bottom side 12*c* thereof and clip member 30 terminates at distal end 30*a* thereof adjacent the opposite, upper side 12*d* of body member 12. Body member 12 has a first lateral side 12*e* (FIG. 1) and an opposite, second lateral side 12*f* (FIGS. 2A and 2B).

The configuration of clip member 30, as best seen in profile view in FIGS. 2, 2D, 3 and 4, is designed to distribute the stresses developed during sideways insertion of the signal transmission lines substantially evenly along the length of the clip profile. That is, when signal transmission lines such as shock tubes, deflagrating tubes or the like are inserted sideways through entryway 34, the fact that the diameter of such tubes is greater than the minimum clearance afforded by entryway 34 requires deflection of clip member 30 to force the line into the line-retaining slot 32. Such deflection causes strain throughout the material of clip member 30. Such strain, thanks to the design of entryway 34 and clip member 30 as described herein, is generally reduced and more evenly distributed along the length of clip member 30 as compared to prior art designs, so that peak stresses are reduced. This reduces the force required for insertion even at extremely low temperatures and reduces the chance that the clip member will be deformed or damaged even at extremely high temperatures. The anticipated temperature range to which the connector blocks may be exposed in storage and use is from about −40° F. to +160° F.

Design of clip member 30, in accordance with the present invention (only one embodiment of which is illustrated in the drawings), can be carried out by the application of constant stress beam theory to the design of the clip member. Constant stress beam theory is typically utilized when designing weight-efficient beams which are to be subjected to static loads. As applied herein to the design of clip member 30 the theory is utilized to minimize peak stresses induced in a curved part when the part is subjected to a given deflection at a given specified load. Accordingly, the design of clip member 30 is analogous, at least for a segment of its length starting from proximal end 30*b* thereof, to that of a constant stress beam, which is a beam whose thickness is optimized such that, for a given load, the bending stress is maintained at a constant value along the length of the beam. The concept is illustrated in FIG. 8 which shows a diagram of a cantilevered beam 70 supported at one end by a support 72, the cross-sectional area of the beam 70 diminishing as sensed moving in the direction from proximal end 70*b* of the cantilevered beam 70 to distal end 70*a* thereof.

For a given load imposed on cantilevered beam 70, the bending stress which results is maintained at a constant value across the length of the beam. This is illustrated by the following formula $$S = \frac{Mc}{I} \tag{1}$$

wherein S is the induced stress due to the bending moment M. Bending moment M is calculated by the following formula $$M=F(x)$$

wherein F is the force applied to the beam and x is the distance between the point at which F is applied and the point at which the cantilevered beam 70 is supported, at support 72 in the diagram of FIG. 8. The bending moment M may therefore be calculated at any given cross section of the cantilevered beam 70 at a distance x from the applied load F.

The constant c/I is a parameter to account for the beam cross section geometry. The bending stress S will be maintained at a constant value for any value of F and x by proper selection of the geometry parameter c/I.

The gripping member of the present invention is attained by curving the hypothetical cantilevered beam 70 by bending the distal end 70*a* thereof upwardly, maintaining beam 70 in a vertical plane passed through its longitudinal axis, i.e., while maintaining the longitudinal axis of beam 70 in the plane of the paper on which FIG. 8 is represented. The resulting curved structure will provide clip member 30 of the present invention, with the added modification of adding a hook-like appendage and an entry guide at distal end 70*a*, for the purposes explained elsewhere herein.

Applying formula (1) to a curved structure such as that of a clip member 30, yields the following formula for calculating the actual stress $S_a$ induced in clip member 30:

$$S_a=Fn/A+Kt(Mc/I) \tag{3}$$

wherein $S_a$ is the stress at a given minimum-area cross section of the clip member, Fn is the component of the reaction load perpendicular to the minimum area cross section, A is the area of the minimum area cross section, c is the distance from the neutral axis of the curved clip member to its outermost fiber on the concave surface of the clip member, that is, the surface which forms part of line-retaining slot 32. Kt is the stress concentration factor to account for the curvature of the clip member, M is the bending moment at the minimum-area cross section imposed by the component of the reaction load parallel to the minimum-area cross section, and I is the section modulus of the clip member.

Figure 4:
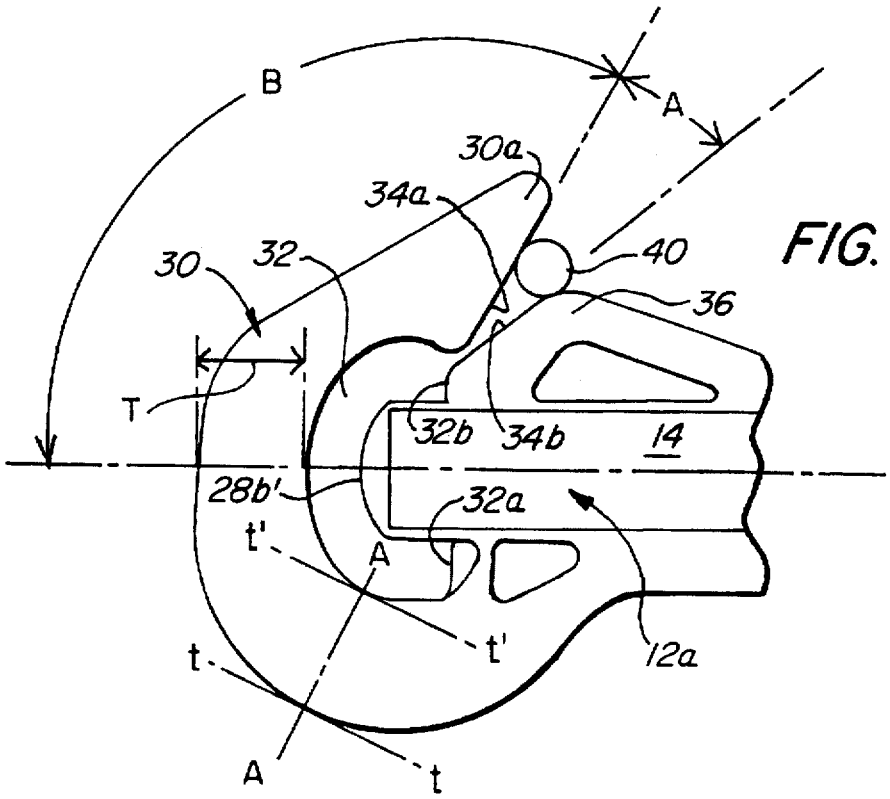
FIG. 4 is a partial, schematic side elevation view of the left-hand (as viewed in FIG. 2) portion of the connector block of FIG. 2 with a transmission line shown in the entryway to the line-retaining slot.

The minimum area cross section is taken through the clip member and is illustrated by the cross section of clip member 30 indicated by the line A—A in FIG. 4, wherein the plane passing through line A—A is perpendicular to lines t—t and t'—t', which are the lines of planes tangent to the profile of clip member 30 as seen in FIG. 4. The minimum area cross section is the cross section cut by the plane A—A.

The stress concentration factor Kt described in connection with the formula, or calculation to determine it, is readily available for particular curvatures from standard reference works in the field of mechanics of materials. For example, see *Stress Concentration Design Factors* by R. E. Peterson, published by John Wiley & Sons, Inc., New York, London, Sydney. The other components of the stress calculation formula given above, as is well-known to those skilled in the art, are readily attainable from standard reference works or by calculation.

FIG. 4 is useful to illustrate the definition of the "thickness" of a clip member as that term is used herein and in the claims. The thickness of clip member 30 at any given point therealong is the thickness as measured along the plane of any minimum area cross section, e.g., the distance measured along plane A—A between lines t—t and t'—t'. For another example, the thickness T (FIG. 4) is the thickness as measured at the mid-point of the clip member 30.

As is known in the art, the strength of the explosive force engendered by initiation of explosive charge 22 (FIG. 3) of detonator 16 may be described with respect to a "blast cone" of explosive force emanating from the explosive charge 22 upon initiation thereof. FIGS. 2B-1 and 2D-1 show a hypothetical blast cone C which is not intended to approximate the actual blast cone but which is intended solely as a hypothetical geometric device to provide reference points for identification of locations along, and the width of, clip member 30. Such identification is further facilitated by considering that portion of clip member 30 from and between proximal end **30*b* thereof to the mid-point thereof to comprise the proximal section 31*b* (FIG. 2D) of clip member 30 and that portion from and between the mid-point of clip member 30 to distal end 30*a* thereof to comprise the distal section 31*a* (FIG. 2D) of clip member 30. As defined elsewhere herein, the mid-point of clip member 30** is its intersection with an extension of longitudinal axis L—L.

Hypothetical blast cone C is considered to emanate from the projection of the periphery of the output end **16*a* of detonator 16 (FIG. 3) onto an imaginary plane I—I (FIGS. 2B-1 and 2D-1) which passes through the discharge end 14*a* (FIG. 2F) of the channel 14 perpendicularly to the longitudinal axis L—L of channel 14. The discharge end of the channel 14 is defined as the location within channel 14 at which the tip of the output end 16*a* of detonator 16 is located. In the illustrated embodiment, the inside surface of stops 28*a*, 28*b* define the discharge end 14*a*, through which plane I—I passes. The surface of the blast cone C is indicated by the dot-dash lines in FIGS. 2B-1 and 2D-1 which lines are extended back from plane I—I to the apex (unnumbered) of the hypothetical blast cone C in order to clearly illustrate the apex angle α thereof. The actual blast effect pattern caused by initiation of explosive charge 22 will differ from (is larger than) the hypothetical blast cone C. Nonetheless, hypothetical blast cone C as defined is, as noted above, useful in defining particular locations along clip member 30 in terms of the intersection of clip member distal segment 31*a*** with a hypothetical blast cone C of various apex angles α. The apex angle α illustrated in FIGS. 2B-1 and 2D-1 is ninety degrees.

Referring again to FIGS. 2B, 2D and 4, clip member 30 is dimensioned and configured to decrease in thickness as sensed moving from proximal end **30*b* thereof at least to a point thereon which would be intersected by a blast cone C having a ninety degree apex angle α, as illustrated in FIGS. 2B-1 and 2D-1. The thickness of clip member 30 is selected to be thick enough to be effective as a shield for shrapnel engendered by initiation of detonator 16, but not so thick as to require excessive force to deflect clip member 30 for sideways insertion of signal transmission lines into line-retaining slot 32**.

Clip member 30 also has a width which is substantially equal to base width w (FIGS. 2A, 2B and 2G) which is the width of clip member 30 at the proximal end **30*b* thereof. The width along clip member 30 from proximal end 30*b* towards distal end 30*a* should be wide enough to not only securely retain signal transmission lines 40 therein, but so that clip member 30 can effectively serve as a shrapnel shield. As best appreciated from FIG. 2B-1, the width of a given design of clip member 30 is best expressed in terms of a width which is wide enough to close, i.e., to block or seal off, a blast cone C of a stated apex angle. Such definition accommodates both the width of the clip member 30 and its distance from the discharge end of channel 14, as determined by the depth of line-receiving slot 32. As seen in FIG. 2B-1, the width of clip member 30 is greater than that required to close off the illustrated blast cone C having an apex angle α of ninety degrees and is great enough to close a blast cone C having a wider apex angle, e.g., one hundred degrees or even larger. As will be appreciated from FIG. 2D-1, because clip member 30 circumscribes more than 180° about the discharge end of channel 14, the length of clip member 30** is more than adequate for shrapnel shielding purposes.

As illustrated in FIG. 2D-1, the thickness of clip member 30 of the illustrated embodiment decreases as sensed moving from proximal end **30*b* to the mid-point of clip member 30. The mid-point of clip member 30 is defined as the intersection of longitudinal axis L—L with clip member 30. From that mid-point to about the intersection of clip member 30 with a blast cone C having apex angle α of about ninety degrees, the thickness of clip member 30 is substantially uniform. From that point to distal end 30*a* the thickness of clip member 30 varies and increases to form distal end 30*a* and entry guide 34*a***.

The proximal end **30*b* of clip member 30 has a pair of stress-relief cavities 38*a*, 38*b* (FIGS. 2A and 2D) formed, respectively, on first lateral side 12*e* and second lateral side 12*f* (FIG. 2A) of connector block 10. These stress-relief cavities help to relieve stress in what tends to be a high stress area, thereby contributing towards maintaining the stress levels in clip member 30 within a relatively narrow range, i.e., avoiding localized high stress levels in proximal end 30*b* of clip member 30. Although triangular-shaped cavities are illustrated, those skilled in the art will recognize that other such cavity configurations such as round, square or other cylindrical shapes, or a cavity which extended entirely through body member 12, i.e., if stress-relief cavities 38*a* and 38*b*** were connected to each other, could be employed to more evenly distribute the stresses.

Referring now to FIGS. 2, 2A and 4, an end wall **32*a* defines the closed end of line-retaining slot 32 and (FIG. 2F) the inner end of entry ramp 34*b* defines the open end 32*b* of line-retaining slot 32. End wall 32*a* is chevron-shaped in plan view (FIG. 2A) to form in cross section an apex 32*a*' at the lateral center of detonator channel 14. As used herein and in the claims, reference to the "lateral center" of the connector block 10 or of any component or portion thereof refers to the center of the connector block as determined, with the block positioned horizontally, by a vertical plane passed therethrough which intersects the center longitudinal axis L—L of detonator channel 14. For example, with reference to FIG. 1, assuming that connector block 10 is positioned horizontally with its bottom side 12*c* (FIG. 2) facing downwardly, a vertical plane passed through center longitudinal axis L—L will define the lateral center of connector block 10. The intersection of the imaginary plane with connector block 10** is shown in FIG. 1 by the dot-dash line. Apex 32a' of end wall 32a is seen to be located at the lateral center and to uniformly taper away from the apex 32a' rearwardly towards locking end 12b.

Stops 28a, 28b have outer surfaces 28a' and 28b' (FIGS. 2, 2B, 2C, 2G and 3) which face towards line-retaining slot 32 and are rounded in profile but do not taper rearwardly towards locking end 12b moving in the direction away from the longitudinal centerline of detonator channel 14 and towards lateral sides 12e, 12f of body member 12. However, in an alternate embodiment such rearward taper could be provided for the entire length of line-retaining slot 32 instead of just a portion thereof as is provided by the structure illustrated in FIG. 2B. FIG. 2G illustrates such tapered version. As is appreciated from FIGS. 2A and 2G, the rearwardly tapered configuration provides a minimum clearance within line-retaining slot 32 along the lateral center thereof. That minimum clearance is normally slightly less than the diameter of the signal transmission lines to be inserted within slot 32 so that the lines are gripped and securely retained in alignment along the lateral center of slot 32 and are thereby retained centered on the output end 16a of detonator 16. With this construction, the clearance available to the signal transmission lines 40 retained within slot 32 is greater in the regions of line-retaining slot 32 which are closer to the opposite lateral sides 12e and 12f of connector block 10. This increasing clearance of slot 32 as sensed moving away from the lateral center towards lateral sides 12e and 12f reduces the frictional resistance of the signal transmission lines 40 as they are inserted sideways into line-retaining slot 32, thereby reducing the force required to insert the signal transmission lines 40 and reducing the stress on clip member 30. Further, the increased clearance of slot 32, in regions away from the lateral center, for example, at the closed end of slot 32 at end wall 32a (FIG. 2) allows the retained signal transmission lines 40 some freedom to flex and bend into a bowed shape, thereby facilitating the insertion of the last signal transmission line or tube (e.g., tube 40/6 of FIG. 2D) which completely fills line-retaining slot 32 and must be "squeezed in" behind the previously inserted tubes.

FIG. 2D shows line-retaining slot 32 filled to its capacity by six signal transmission lines 40 which are sub-numbered 1 through 6, respectively, to indicate both their position within line-retaining slot 32 and the order in which they were introduced therein through entryway 34. FIG. 5 shows, partly broken away and partly in phantom outline, signal transmission line 40/1 in place within line-retaining slot 32 at the closed end thereof and signal transmission line 40/2 about to be inserted sideways into line-retaining slot 32 via entryway 34 (FIG. 2D).

Figure 2F:
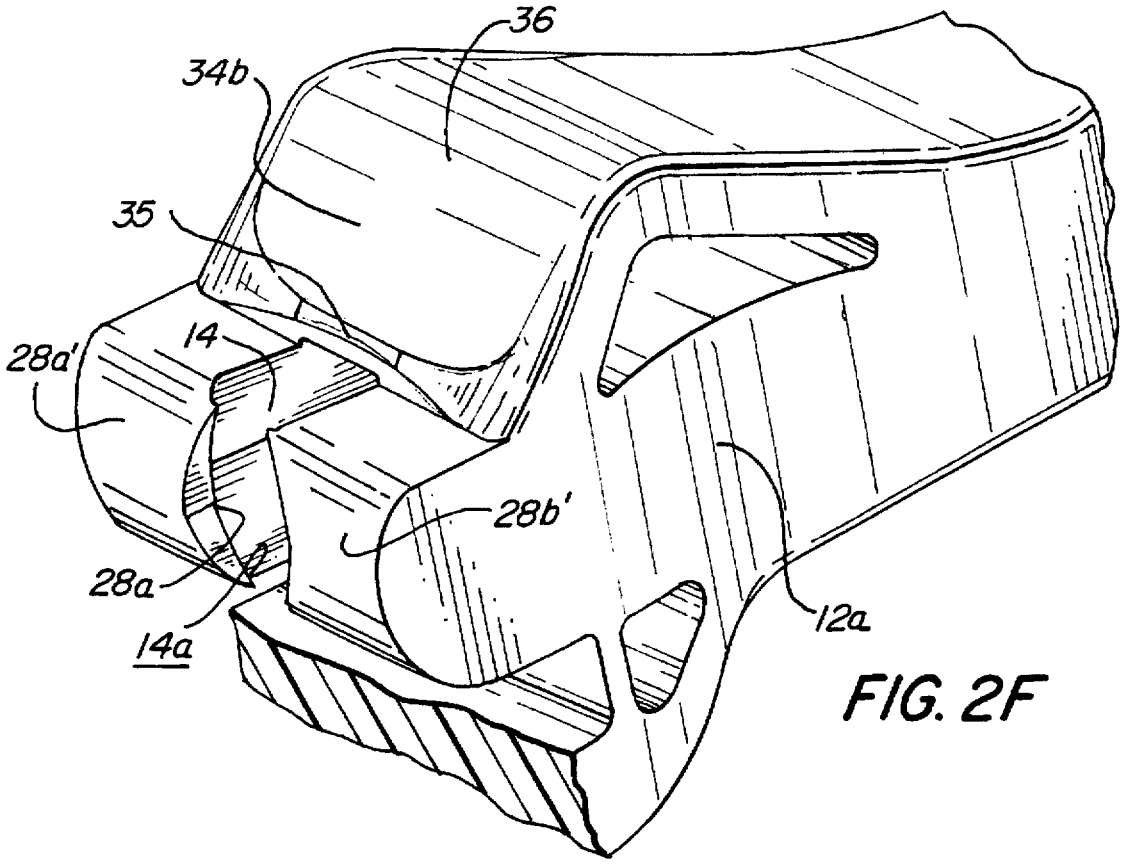
FIG. 2F is a partial perspective view, with parts broken away, of the signal transmission end of the connector block of FIG. 1.
Figure 2E:
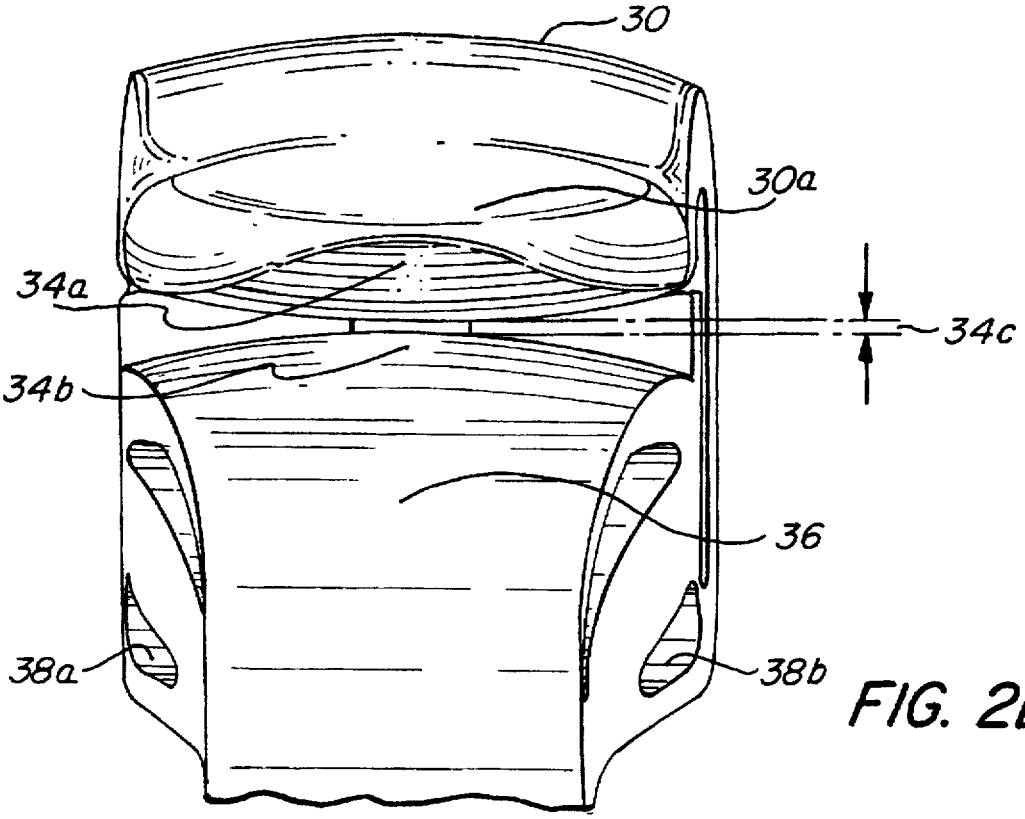
FIG. 2E is a perspective view taken along line 2E—2E of FIG. 1.

The rounded profile of the outer surfaces 28a' and 28b' of stops 28a, 28b, as best seen in FIGS. 2F and 4, facilitates smooth entry sideways insertion of signal transmission lines 40/1 through 40/5 (FIG. 2D) into line-retaining slot 32. Further, the rounded profile shifts the signal transmission lines 40/3 and 40/4 away from output end 16a of detonator 16 and thereby permits signal transmission lines 40/2 and 40/5 to be positioned closer to the centerline (center longitudinal axis L—L) of detonator 16 and thereby closer to the area of maximum explosive force generated by detonation of explosive charge 22 (FIG. 3) contained in output end 16a. This improves the reliablility of initiation of a signal within the signal transmission lines 40/2 and 40/5 at positions 2 and 5 without adversely effecting the prospects for initiation of the lines 40/3 and 40/4 in positions 3 and 4 because the latter, although moved slightly away from explosive charge 22, are still in the direct line of fire thereof.

Referring now to FIG. 4, there are illustrated angles measured in the vertical center plane passed through the longitudinal center axis L—L of detonator channel 14 (and of connector block 10), i.e., the plane of the paper on which FIG. 4 is rendered. (Cross-sectional cross-hatching is omitted from schematic FIG. 4.) The signal transmission end 12a and clip member 30 of connector block 10 in outline instead of in cross section.) The entryway angle A is the angle formed between entry guide 34a and entry ramp 34b. Angle A is selected to provide the optimum mechanical advantage in forcing open clip member 30 by sideways insertion of signal transmission line 40 therethrough. What is desired is that entryway angle A be small enough so that the work path for sideways insertion of signal transmission line 40, i.e., the distance which line 40 travels in contact with and imposing a force upon both entry guide 34a and entry ramp 34b, is sufficiently long so that the work required to force open clip member 30 sufficiently to admit line 40 into line-retaining slot 32 is spread over the work path thereby to reduce the peak load. In the illustrated embodiment, a suitable entryway angle is 20 degrees and, generally, this angle will preferably be from about 18 degrees to about 22 degrees. Preferably, the length of work path travel of signal transmission line 40, i.e., travel while imposing a force on both entry guide 34a and ramp guide 34b, will be from about 1.5 to 4 times the diameter of signal transmission line 40. For example, a connector block designed for use with conventional sized shock tube having an outside diameter of about 3.05 mm (0.120 inch) may employ an entryway having a work path length of from about 4.6 to 12.3 mm (0.18 to 0.48 inch). Construction of entryway 34, entry guide 34a and entry ramp 34b in accordance with the present invention provides a structure which helps to avoid or reduce the need for high peak forces for sideways insertion of the signal transmission lines 40 into the line-retaining slot 32.

The clip member reaction angle B is selected so that the force applied to entry guide 34a acts generally perpendicularly to the theoretical "hinge" about which clip member 30 flexes to open for admitting line 40 into line-retaining slot 32. This maximizes the efficiency of the force applied to flex clip member 30 open and thereby also helps to reduce peak stresses in clip member 30.

In the embodiment illustrated, entry guide 34a and entry ramp 34b are curved in profile as best seen in FIG. 2E and are closest together to provide the minimum clearance 34c at the center of connector block 10 so that frictional resistance to the sideways insertion of lines 40 is reduced while the forces imposed by the sideways insertion of lines 40 on entry ramp 34b and entry guide 34a are imposed essentially only in the vertical center plane passing through longitudinal centerline L—L of detonator channel 14 (and of connector block 10).

Referring now to FIG. 2F, entry ramp 34b formed on raised formation 36 is seen to include a rectangular, small flat shoulder section 35 near the end of entry ramp 34b. Flat shoulder section 35 provides a positive effect in increasing the force required for withdrawal of a retained signal transmission line 40 from line-retaining slot 32. Thus, despite the relatively low forces required to insert a signal transmission line 40 sideways into line-retaining slot 32, a sufficient high withdrawal force is required, thus helping to preclude inadvertent withdrawal of a retained signal transmission line. Such withdrawal, if undetected, would of course have the disastrous effect of taking one of the signal transmission lines 40 out of signal transfer range with the detonator 16.

Figure 6:
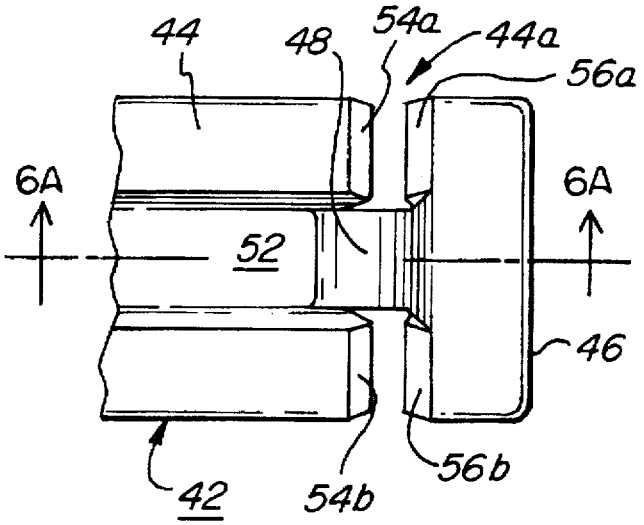
FIG. 6 (PRIOR ART)
FIG. 6 is a partial top view of the signal transmission end of a first prior art connector block.
Figure 6A:
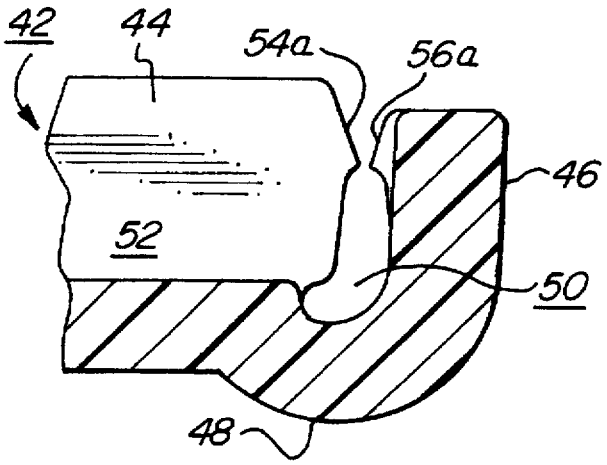
FIG. 6A (PRIOR ART)
FIG. 6A is a cross-sectional elevation view taken along line A—A of FIG. 6.

FIGS. 6 and 6A are partial views of the signal transmission end 44a of the body member 44 of a first prior art connector block 42. Connector block 42 has a gripping member 46 connected to the end of body member 44 by a resiliently deformable segment or neck 48. A line-retaining slot 50 is formed between gripping member 46 and body member 44. An open, trench-like channel 52 is formed within body member 44 and has gripping means (not shown) formed therein to retain a detonator within channel 52 with its output end positioned adjacent to line-retaining slot 50. Entry ramps 54a, 54b and entry guides 56a, 56b are provided to form an entryway into slot 50 for the sideways insertion therein of signal transmission lines such as shock tubes, not shown in FIG. 6 or 6A.

Figure 7:
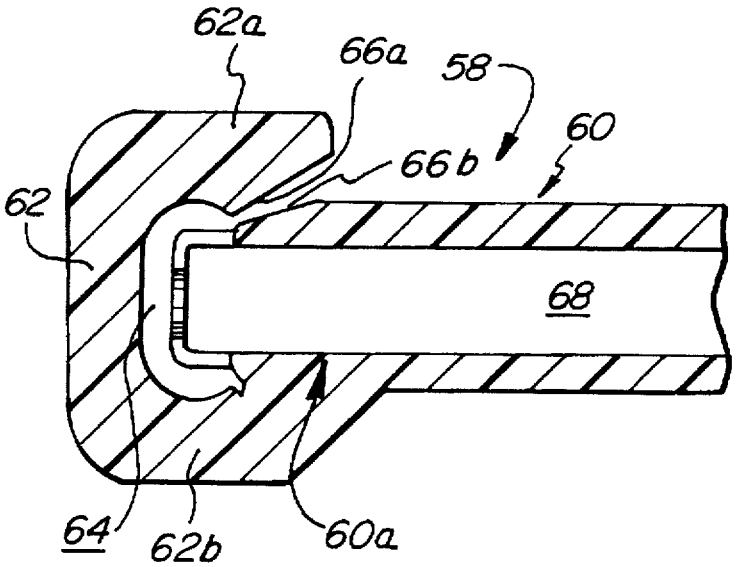
FIG. 7 (PRIOR ART)
FIG. 7 is a partial cross-sectional elevational view taken along the longitudinal axis of a second prior art connector block.

FIG. 7 is a partial view of the signal transmission end 60a of the body member 60 of a second prior art connector block 58. Connector block 58 has a gripping member 62 which is spaced from body member 60 to define therebetween a line-retaining slot 64. Gripping member 62 has a proximal end 62b carried by body member 60 and a distal end 62a on which is carried an entry guide 66a. Entry ramp 66b is positioned at body member 60 opposite entry guide 66a to provide an entryway to line-retaining slot 64. A channel 68 is formed within body member 60.

A calculation was made of the forces required to insert signal transmission lines sideways into the line-retaining slots provided by the two prior art connector blocks of FIGS. 6/6A (referred to below as "comparative block A") and that of FIG. 7 (referred to below as "comparative block B") and the embodiment of the present invention illustrated in FIGS. 1–5 hereof (referred to below as "the FIG. 2 block). Calculations were carried out for connector blocks having the following specifications and configured as shown in, respectively, FIGS. 2, 6/6A, and 7. The calculations gave the results summarized in the following TABLE, wherein comparative is abbreviated as "Comp.".

TABLE

| Connector Block | Tube[1] Capacity | DL[2] (kg) | MS[3] (cm/cm) |
|---|---|---|---|
| Comp. Block A (FIGS. 6, 6A) | Four | 23.6 | 0.130 |
| Comp. Block B (FIG. 7) | Six | 46.9 | 0.063 |
| FIG. 2 Block (FIGS. 1–5) | Six | 27.3 | 0.047 |

[1]Capacity based on standard size shock tube having a nominal outside diameter of 3.05 mm (0.120 inch)
[2]Deflection Load, the force required to deflect the clip member 0.120 inches (3.05 mm) in the opening direction, in kilograms.
[3]Maximum Strain, the maximum strain induced in the clip member by the deflection load.

The data of the TABLE were calculated based on the respective designs of comparative block A, comparative block B and the FIG. 2 block of the invention, all having the same material properties, i.e., assuming that all three blocks were made from the same thermoplastic material. The calculations were further based on the premise that the width w (FIGS. 2B and 2G) of each of the three clip members is identical and the thickness T (FIG. 4) of the clip members of comparative block B and the FIG. 2 block at the mid-points thereof (at the point where an extension of the longitudinal axis of the detonator-receiving channel intersects the clip member) is 5.283 mm (0.208 inches). The thickness T (FIG. 4) of comparative block A does not enter into the calculations because comparative block A flexes substantially entirely at neck 48 thereof, so that substantially all the bending stresses are localized in neck 48. Accordingly, the thickness of the clip or gripping member 46 of comparative block A at its mid-point is not germane to calculating either the Deflection Load or Maximum Stress of the TABLE. The calculations were based on neck 46 having a width (as seen in FIG. 6) of 6.35 mm (0.25 inch) and a depth (as seen in FIG. 6A) of 6.35 mm (0.25 inch). The effect of forcing a deflection on the clip members of comparative blocks A and B and the FIG. 2 block sufficient to force open the entryway to provide a clearance of 3.05 mm (0.120 inch) at the entryway (e.g., entryway 34 of FIG. 3) was calculated in a direction along the plane (P—P in FIG. 2E) which is perpendicular to entryway 34 at the minimum clearance 34c thereof. In the illustrated embodiment, the plane P—P is the vertical plane, referred to above, which intersects the longitudinal axis of the connector block to define the "lateral center" thereof.

It will be noted from the TABLE that the force required to open the clip to attain the 3.05 mm (0.120 inch) deflection is 23.6 kg (52 lbs.) for comparative block A, 46.9 kg (103.5 lbs.) for comparative block B and 27.3 kg (60.2 lbs.) for the FIG. 2 block. Although comparative block A required slightly less opening force to attain the desired opening deflection, it sustains a significantly higher maximum strain than does either comparative block B or the FIG. 2 block. The high maximum strain sustained by comparative block A is due to the narrow neck portion thereof (48 in FIG. 6) in which the deflection stress is concentrated. It is apparent from the much higher maximum strain of comparative block A as compared to the FIG. 2 block, that the latter would be much more capable of withstanding large deflections or operating under very high temperature conditions than would comparative block A.

Although the maximum strain of comparative block B is much better than that of comparative block A, it is still significantly higher than that of the FIG. 2 block.

In addition to the maximum strain sustained by comparative block B being 1.34 times the maximum strain of the FIG. 2 block, the deflection load required to attain the 3.05 mm (0.120 inch) deflection of comparative block B is seen to be 1.72 times higher than that required by the FIG. 2 block. If it were desired to reduce the deflection load of comparative block B to be identical to that of the FIG. 2 block, the shielding thickness of comparative block B would have to be reduced from 5.588 mm (0.220 inches) to about 3.912 mm (0.154 inches). (This calculation is based on the fact that bending stiffness of the clip member will vary with the third power of the clip thickness T.) In comparison, the FIG. 2 block has a shielding thickness of about 5.283 mm (0.208 inches)

While the invention has been described with reference to a particular preferred embodiment thereof, it will be apparent to those skilled in the art upon a reading and understanding of the foregoing that numerous connector block designs other than the specific embodiment illustrated are attainable which nonetheless lie within the spirit and scope of the present invention. It is intended to include all such other designs and substantial equivalents thereof within the scope of the appended claims.

What is claimed is:

1. In a connector block for retaining one or more signal transmission lines in signal transfer relationship with a detonator, the connector block comprising:

a body member having a signal transmission end and a detonator channel having a longitudinal axis and terminating in a discharge end, the channel extending within the body member for receiving and retaining therein a detonator having an output end, with the output end disposed at the discharge end of the channel when the detonator is seated therein, the projection of the periphery of the output end of such seated detonator on a plane passed through the discharge end of the channel perpendicularly to the longitudinal axis thereof serving as the origin of a hypothetical blast cone emanating from the discharge end of the channel and having a given apex angle;

a line-retaining, curved clip member disposed at the signal transmission end of the body member and cooperating therewith to define therebetween a line-retaining slot extending transversely of the longitudinal axis of the channel for receiving and retaining therein at least one signal transmission line in signal communication relationship with such output end of a detonator retained within the receiving channel, the clip member having a proximal end carried on the body member and an opposite, distal end and the line-retaining slot having a closed end adjacent the proximal end of the clip member and an open end adjacent the distal end of the clip member;

an entryway formed between the distal end of the clip member and the body member, the entryway being dimensioned and configured to admit sideways insertion of such transmission line therethrough and into the line-retaining slot by displacement of the clip member, thereby imposing a reaction load on the clip member:

the improvement comprising that the clip member is dimensioned and configured to be of continuously decreasing thickness as sensed moving longitudinally along the clip member from the proximal end thereof to at least about the first-encountered intersection of the clip member with a blast cone having a ninety degree apex angle.

2. The connector block of claim 1 wherein the clip member is of continuously decreasing thickness as sensed moving longitudinally along the clip member from the proximal end thereof to about the mid-point of the clip member, the mid-point being defined as the intersection of an extension of the longitudinal axis with the clip member, and the clip member has a clip member distal segment defined as extending from the mid-point of the clip member to the distal end thereof, and wherein the clip member distal segment is of substantially uniform thickness from about the mid-point of the clip member to at least about the intersection of the clip member distal segment with a hypothetical blast cone having a ninety degree apex angle.

3. The connector block of claim 1 or claim 2 wherein the clip member has a base width at the proximal end thereof and the width of the clip member between the proximal end thereof and about the open end of the line-retaining slot is not less than the base width.

4. The connector block of claim 3 wherein the base width is at least wide enough to close a hypothetical blast cone having a ninety degree apex angle.

5. The connector block of claim 3 wherein the base width is at least wide enough to close a hypothetical blast cone having a one hundred degree apex angle.

6. The connector block of claim 1 wherein the body member has a bottom side and an opposite upper side, the proximal end of the clip member is carried on the bottom side and the distal end of the clip member terminates adjacent the upper side.

7. The connector block of claim 1 or claim 2 wherein the clip member has a clip member distal segment defined as extending from the mid-point of the clip member to the distal end thereof, the mid-point of the clip member being defined as the intersection of an extension of the longitudinal axis with the clip member, and wherein the clip member is dimensioned and configured to have, at least between the proximal end thereof and the intersection with the clip member distal segment of a hypothetical blast cone having a ninety degree apex angle, the geometry of a constant stress beam having a beam longitudinal axis, in that the clip member is of continuously decreasing thickness as sensed moving longitudinally therealong from the proximal end thereof towards the distal segment thereof; and which constant stress beam has been formed into a curved configuration by curving the beam while keeping the beam longitudinal axis in a vertical plane passed through the beam longitudinal axis.

8. The connector block of claim 1 or claim 2 comprised of a synthetic organic polymeric material.

9. The connector block of claim 8 wherein the synthetic organic polymeric material is selected from the group consisting of polyethylene, polypropylene, polybutylene, and acrylonitrile-butadiene-styrene copolymer.

10. The connector block of claim 1 or claim 2 further comprising an entry guide carried on the distal end of the clip member and an entry ramp carried on the body member, the entry guide and entry ramp being disposed on respective opposite sides of the entryway and converging towards each other to define a converging entryway as sensed moving in the direction leading into the line-retaining slot, the entry guide and the entry ramp affording an entryway clearance between them and defining between them an entry angle of from about 18 degrees to 22 degrees and the entry guide defining with the center longitudinal axis of the detonator channel a clip reaction angle of from about 115 degrees to 120 degrees.

11. The connector block of claim 10 wherein the entry angle is about 20 degrees and the clip reaction angle is about 120 degrees.

12. The connector block of claim 1 or claim 2 in combination with a detonator having an output end, the detonator being seated within the detonator channel with the output end of the detonator disposed at the discharge end of the channel.

13. The connector block of claim 12 wherein the detonator is a delay detonator.

14. The connector block of claim 1 or claim 2 further including one or more stress-relief cavities formed in the proximal end of the clip member.

15. The connector block of claim 1 or claim 2 further comprising an entry ramp carried on the body member in the entryway, the entry ramp having a flat shoulder disposed at the open end of the line-retaining slot.

16. The connector block of claim 1 or claim 2 wherein the line-retaining slot is of arcuate configuration and is dimensioned and configured to displace away from the discharge end of the channel such signal transmission lines retained within the line-retaining slot as are axially aligned with the channel, whereby to permit such retained signal transmission lines as are adjacent to the displaced signal transmission lines to be positioned closer to the channel discharge end.

17. In a connector block for retaining one or more signal transmission lines in signal transfer relationship with a detonator, the connector block comprising:

a body member having a signal transmission end and a detonator channel having a longitudinal axis and terminating in a discharge end, the channel extending within the body member for receiving and retaining therein a detonator having an output end, with the output end disposed at the discharge end of the channel when the detonator is seated therein, the projection of the periphery of the output end of such seated detonator on a plane passed through the discharge end of the channel perpendicularly to the longitudinal axis thereof serving as the origin of a hypothetical blast cone emanating from the discharge end of the channel and having a given apex angle;

a line-retaining, curved clip member disposed at the signal transmission end of the body member and cooperating therewith to define therebetween a line-retaining slot extending transversely of the longitudinal axis of the channel for receiving and retaining therein at least one signal transmission line in signal communication relationship with such output end of a detonator retained within the receiving channel, the clip member having a proximal end carried on the body member and an opposite, distal end and the line-retaining slot having a closed end adjacent the proximal end of the clip member and an open end adjacent the distal end of the clip member;

an entryway formed between the distal end of the clip member and the body member, the entryway being dimensioned and configured to admit sideways insertion of such transmission line therethrough and into the line-retaining slot by displacement of the clip member, thereby imposing a reaction load on the clip member;

the improvement comprising that:

an entry guide is carried on the distal end of the clip member and an entry ramp is carried on the body member, the entry guide and entry ramp being disposed on respective opposite sides of the entryway to afford an entryway clearance between them, and converging towards each other to define a converging entryway as sensed moving in the direction leading into the line-retaining slot, and the entryway clearance changes as sensed moving laterally across the width of the entryway; and the clip member is dimensioned and configured to be of continuously decreasing thickness as sensed moving longitudinally along the clip member from the proximal end thereof to at least about the first-encountered intersection of the clip member with a blast cone having a ninety degree apex angle, the entry guide and the entry ramp defining between them an entry angle of from about 18 degrees to 22 degrees and the entry guide defining with the center longitudinal axis of the detonator channel a clip reaction angle of from about 115 degrees to 120 degrees.

18. The connector block of claim 17 wherein the entryway clearance decreases as sensed moving laterally across the width of the entryway in opposite inward directions from the opposite lateral sides of the connector block to a point where the entryway clearance is at a minimum.

19. The connector block of claim 18 wherein the entryway clearance is at a minimum at, and is symmetrical about, the lateral center of the entryway.

20. In a connector block for retaining one or more signal transmission lines in signal transfer relationship with a detonator, the connector block comprising:

a body member having a signal transmission end and a detonator channel having a longitudinal axis and terminating in a discharge end, the channel extending within the body member for receiving and retaining therein a detonator having an output end, with the output end disposed at the discharge end of the channel when the detonator is seated therein, the projection of the periphery of the output end of such seated detonator on a plane passed through the discharge end of the channel perpendicularly to the longitudinal axis thereof serving as the origin of a hypothetical blast cone emanating from the discharge end of the channel and having a given apex angle;

a line-retaining, curved clip member disposed at the signal transmission end of the body member and cooperating therewith to define therebetween a line-retaining slot extending transversely of the longitudinal axis of the channel for receiving and retaining therein at least one signal transmission line in signal communication relationship with such output end of a detonator retained within the receiving channel, the clip member having a proximal end carried on the body member and an opposite, distal end and the line-retaining slot having a closed end adjacent the proximal end of the clip member and an open end adjacent the distal end of the clip member;

an entryway formed between the distal end of the clip member and the body member, the entryway being dimensioned and configured to admit sideways insertion of such transmission line therethrough and into the line-retaining slot by displacement of the clip member, thereby imposing a reaction load on the clip member:

the improvement comprising that the clip member is dimensioned and configured to be of continuously decreasing thickness as sensed moving longitudinally along the clip member from the proximal end thereof to at least about the first-encountered intersection of the clip member with a blast cone having a ninety degree apex angle, and the line-retaining slot affords a slot clearance between the clip member and the body member, and the slot clearance changes as sensed moving laterally of the connector body across the width of the slot.

21. The connector block of claim 20 wherein the slot clearance changes as sensed moving laterally across the width of the slot in opposite inward directions from the opposite lateral sides of the connector block to a point where the slot clearance is at a minimum.

22. The connector block of claim 21 wherein the slot clearance is at a minimum at, and is symmetrical about, the lateral center of the slot.

23. The connector block of claim 17 or claim 20 wherein the clip member is of decreasing thickness as sensed moving longitudinally along the clip member from the proximal end thereof to about the mid-point of the clip member, the mid-point being defined as the intersection of an extension of the longitudinal axis with the clip member, and the clip member has a clip member distal segment defined as extending from the mid-point of the clip member to the distal end thereof, and wherein the clip member is of substantially uniform thickness from about the mid-point of the clip member to at least about the intersection of the clip member distal segment with a hypothetical blast cone having a ninety degree apex angle.

* * * * *

UNITED STATES PATENT AND TRADEMARK OFFICE

CERTIFICATE OF CORRECTION

PATENT NO. : 5,703,319
DATED : December 30, 1997
INVENTOR(S) : James E. Fritz et al It is certified that error appears in the above-identified patent and that said Letters Patent is hereby corrected as shown below:

In column 5, line 2 of the description of Figure 6A, replace "A—A" with --6A—6A--.

In column 7, line 2, replace "connector body" with --body member--.

In column 12, line 6, delete ")";
line 7, insert --are-- after "connector block 10".

In column 13, line 26, replace "6/6A" with --6, 6A--;
line 29, insert --"-- after "block";
line 32, replace "6/6A" with --6, 6A--;
in footnote 2 of the TABLE, replace "inches" with --inch--;
line 61, replace "inches" with --inch--.

Signed and Sealed this

Sixteenth Day of February, 1999

*Attest:*

*Attesting Officer*

*Acting Commissioner of Patents and Trademarks*

UNITED STATES PATENT AND TRADEMARK OFFICE

CERTIFICATE OF CORRECTION

PATENT NO. : 5,703,319
DATED : December 30, 1997
INVENTOR(S) : James E. Fritz et al It is certified that error appears in the above-identified patent and that said Letters Patent is hereby corrected as shown below:

In column 14, line 42, replace "inches" with --inch--;
line 43, replace "inches" with --inch--;
line 47, replace "inches" with --inch--.

In Figure 2B-1, insert a lead line from the angle α.

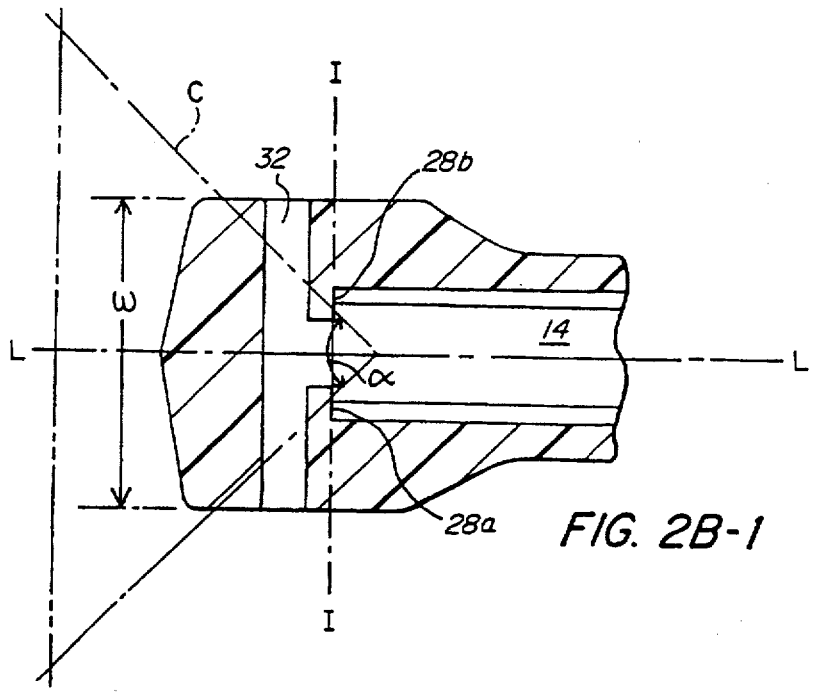

FIG. 2B-1